US008519284B2

(12) United States Patent
Nakatani et al.

(10) Patent No.: US 8,519,284 B2
(45) Date of Patent: Aug. 27, 2013

(54) ELECTRONIC DEVICE

(75) Inventors: Tadashi Nakatani, Kawasaki (JP); Hiroaki Inoue, Kawasaki (JP); Satoshi Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 374 days.

(21) Appl. No.: 12/940,303

(22) Filed: Nov. 5, 2010

(65) Prior Publication Data

US 2011/0132734 A1 Jun. 9, 2011

(30) Foreign Application Priority Data

Dec. 3, 2009 (JP) ..... 2009-275610

(51) Int. Cl.
*H01H 57/00* (2006.01)

(52) U.S. Cl.
USPC ..... 200/181; 335/78

(58) Field of Classification Search
USPC ..... 200/181; 335/78
See application file for complete search history.

(56) References Cited

U.S. PATENT DOCUMENTS

| | | | | |
|---|---|---|---|---|
| 7,515,023 | B2 * | 4/2009 | Nakatani et al. | 335/78 |
| 7,535,326 | B2 * | 5/2009 | Nakatani et al. | 335/78 |
| 8,110,761 | B2 * | 2/2012 | Nakatani et al. | 200/181 |
| 2005/0225921 | A1 | 10/2005 | Nakatani | |
| 2009/0212886 | A1 * | 8/2009 | Satoh et al. | 333/204 |
| 2011/0024274 | A1 | 2/2011 | Yoshihara et al. | |

FOREIGN PATENT DOCUMENTS

| | | | |
|---|---|---|---|
| CN | 1190788 | A | 8/1998 |
| EP | 0822579 | A1 | 2/1998 |
| JP | 2005-528751 | A1 | 9/2005 |
| JP | 2005-293918 | A1 | 10/2005 |
| JP | 2006-210530 | A1 | 8/2006 |
| JP | 2009-245877 | | 10/2009 |
| WO | WO 03/102989 | A1 | 12/2003 |

OTHER PUBLICATIONS

Chinese Office Action dated Mar. 27, 2013, with English Translation, in counterpart Chinese Application No. 201010570789.

* cited by examiner

*Primary Examiner* — Amy Cohen Johnson
*Assistant Examiner* — Marina Fishman
(74) *Attorney, Agent, or Firm* — Kratz, Quintos & Hanson, LLP

(57) ABSTRACT

An electronic device includes a substrate including an active layer, a signal electrode formed on a surface of the active layer, a first driving electrode that is formed on the surface of the active layer and is connected to a ground, and a second driving electrode including a first part that is formed on the surface of the active layer and a second part that is connected to the first part and is provided above the first driving electrode. The substrate is provided with a loop-like groove that penetrates through the active layer and encompasses the first part.

3 Claims, 16 Drawing Sheets

ELECTRONIC DEVICE

CROSS-REFERENCE TO RELATED APPLICATION

This application is based upon and claims the benefit of priority of the prior Japanese Patent Application No. 2009-275610, filed on Dec. 3, 2009, the entire contents of which are incorporated herein by reference.

FIELD

The embodiments discussed herein are related to an electronic device formed on a surface of a substrate in which an active layer is provided on an insulation layer.

BACKGROUND

Conventionally, in order to respond to a demand for miniaturization and high-performance of high-frequency components (RF components) for use in mobile phones, developments of MEMS switches as high-frequency (RF) switches have been in progress by use of MEMS (Micro Electro Mechanical Systems) techniques. The MEMS switches have, as features thereof, lower loss, higher isolation, good distortion properties, and so on as compared with conventional semiconductor switches.

Various types of MEMS switches having different structures have conventionally been proposed (see Japanese National Publication of International Patent Application No. 2005-528751 and Japanese Laid-open Patent Publication Nos. 2005-293918 and 2006-210530).

FIG. 11 is a plan view illustrating a conventional MEMS switch 80*j*, and FIGS. 12A-12C are cross sections of the MEMS switch 80*j*. To be specific, FIGS. 12A-12C are cross sectional views of the MEMS switch 80*j* taken along the line J1-J1, the line J2-J2, and the line J3-J3 in FIG. 11, respectively.

Referring to FIGS. 11-12C, the MEMS switch 80*j* is formed of a substrate 81 on which a lower contact electrode 82, an upper contact electrode 83, a lower driving electrode 84, an upper driving electrode 85, a ground electrode 86, and so on are formed. The lower contact electrode 82 and the lower driving electrode 84 are integrated with a movable portion KB that constitutes a cantilever.

The substrate 81 is a Silicon-on-Insulator (SOI) substrate. A slit ST is formed on an active layer of the SOI substrate; thereby to define the movable portion KB. The lower contact electrode 82 and the lower driving electrode 84 are formed on the active layer by plating.

The lower contact electrode 82 and the upper contact electrode 83 are used as a high-frequency signal line. The high-frequency signal line forms a coplanar line structure along with the upper driving electrode 85 and the ground electrode 86 that are provided to interpose the high-frequency signal line therebetween, which results in the low transmission loss.

The upper driving electrode 85 is connected to the ground. When a driving voltage VD is applied between the upper driving electrode 85 and the lower driving electrode 84, an electrostatic attractive force is generated therebetween with which the lower driving electrode 84 is attracted toward and moved to the upper driving electrode 85. In this way, the movable portion KB that is integrated with the lower driving electrode 84, and the lower contact electrode 82 move, and the lower contact electrode 82 touches the upper contact electrode 83 so that the contacts close. At this time, if the driving voltage VD is set at zero, the contacts of the lower contact electrode 82 and the upper contact electrode 83 separate from each other due to the elasticity of the movable portion KB.

In the MEMS switch 80*j* having a conventional structure discussed above, when a driving voltage is applied to the lower driving electrode 84, a leakage current Ia flows from the lower driving electrode 84 through the active layer of the movable portion KB to the lower contact electrode 82 functioning as the high-frequency signal line.

Even in the case of the movable portion KB made of high-resistance silicon, the leakage current Ia is, for example, approximately 10 μA when the driving voltage VD is 40 V. In such a case, power consumption due to the leakage current Ia is 400 μw. The level of the power consumption is not a negligible level in, for example, a portable terminal.

The leakage current Ia is eventually carried to the contacts of the high-frequency signal line, which is probably a cause of contact sticking.

SUMMARY

According to an aspect of the invention (embodiment), an electronic device includes a substrate including an active layer, a signal electrode formed on a surface of the active layer, a first driving electrode that is formed on the surface of the active layer and is connected to a ground, and a second driving electrode including a first part that is formed on the surface of the active layer and a second part that is connected to the first part and is provided above the first driving electrode. The substrate is provided with a loop-like groove that penetrates through the active layer and encompasses the first part.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Preferred embodiments of the present invention will be explained below with reference to accompanying drawings.

The embodiments are examples and various modifications may be made to the structure, the shape, the size, the material, and the like of MEMS switches of the embodiments.

[First Embodiment]

Descriptions are given of a MEMS switch 1 of the first embodiment with reference to FIGS. 1-6. FIGS. 2A-2C are cross sectional views of the MEMS switch 1 taken along the line A-A, the line B-B, and the line C-C in FIG. 1, respectively.

Figure 1:
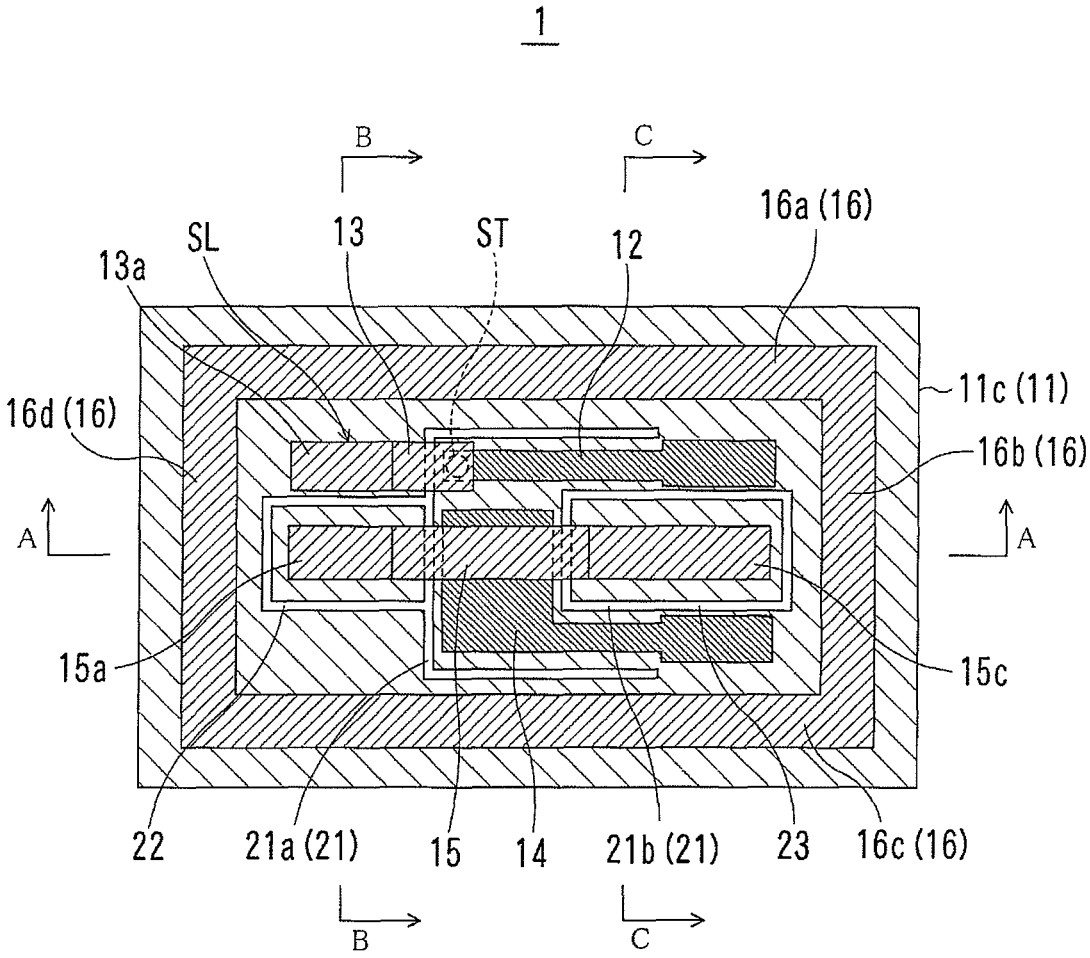
FIG. 1 is a plan view of a MEMS switch according to a first embodiment.
Figure 2A:
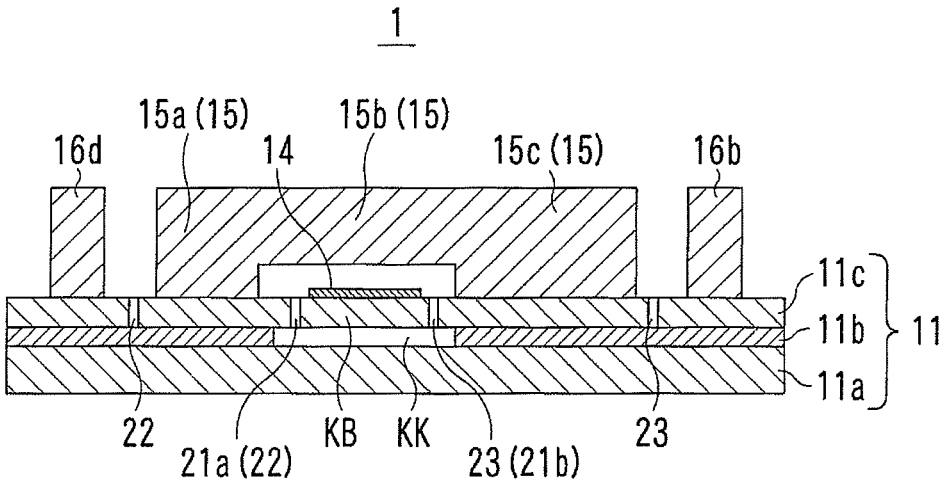
FIGS. 2A-2C are cross sectional views of the MEMS switch illustrated in FIG. 1.
Figure 2B:
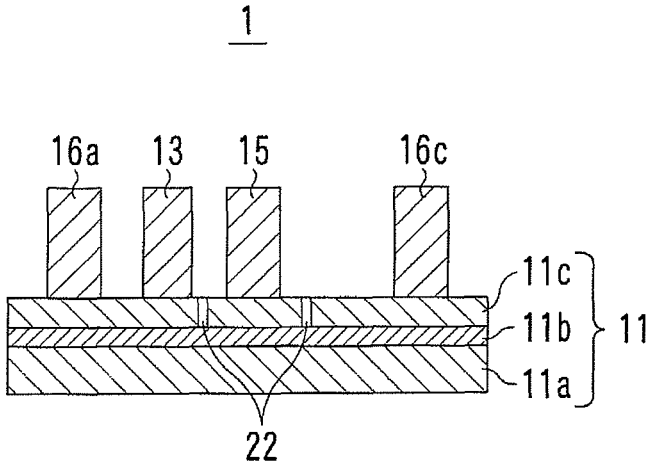
Figure 2C:
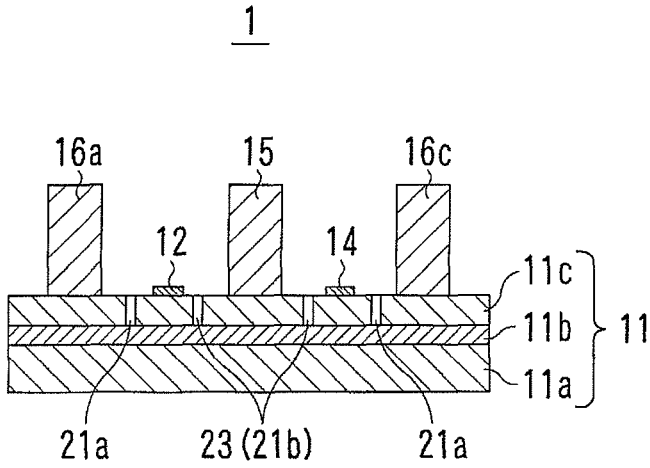
Figure 3:
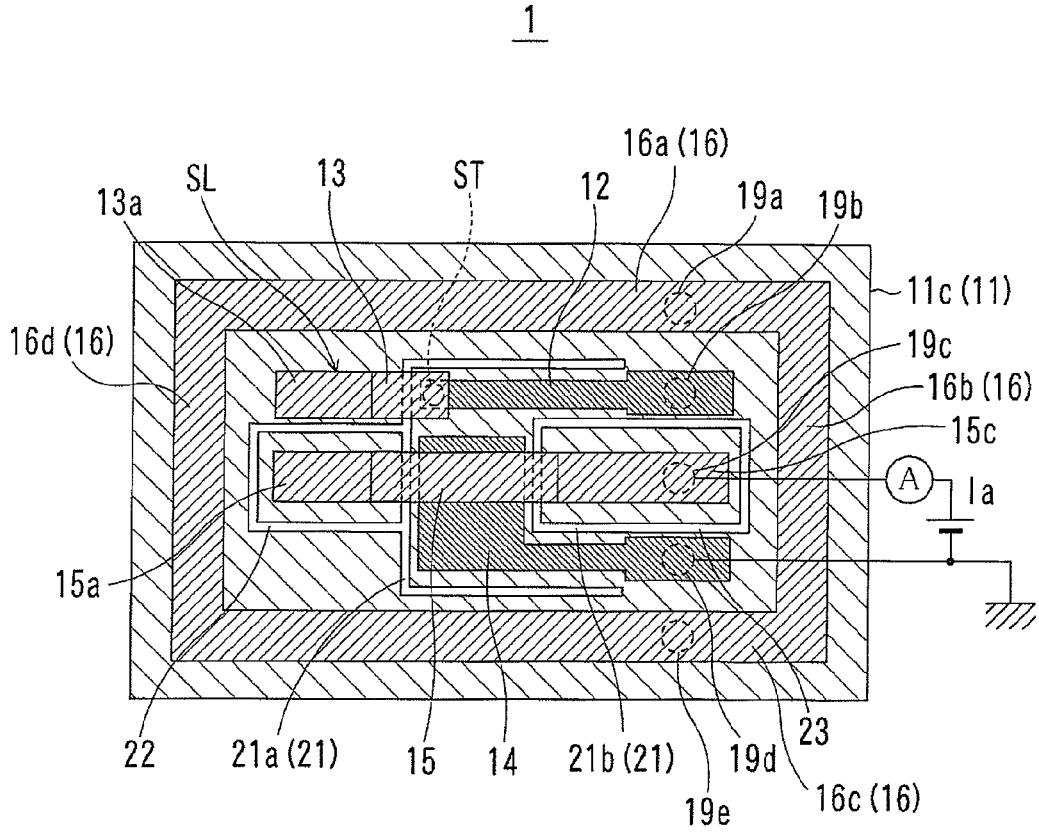
FIG. 3 is a diagram depicting a method for measuring a leakage current in a MEMS switch.

Note that, in FIGS. 1-3, parts not corresponding to the cross-sections are also hatched in order to facilitate the understanding of the shapes of the individual portions.

Referring to FIGS. 1 and 2, the MEMS switch 1 is a high-frequency MEMS switch, i.e., an RF-MEMS switch. The MEMS switch 1 includes a substrate 11, a lower contact electrode 12, an upper contact electrode 13, a lower driving electrode 14, an upper driving electrode 15, and a ground electrode 16.

The substrate 11 is an SOI (Silicon On Insulator) substrate including three layers, namely, a support substrate 11*a*, an intermediate oxide film 11*b*, and an active layer 11*c*. The support substrate 11*a* is made of silicon and has a thickness of, for example, approximately 500 μm. The intermediate oxide film 11*b* is an insulation layer made of $SiO_2$, and has a thickness of, for example, approximately 4 μm. The active layer 11*c* is a silicon thin film, and has a thickness of, for example, approximately 15 μm. The resistivity of the silicon of the SOI substrate is approximately 1000 Ωcm or larger.

The active layer 11*c* is provided with two slits 21 having a substantially horizontal U-shape in plan view (front view), i.e., a large slit 21*a* and a small slit 21*b*, which define the movable portion KB. The intermediate oxide film 11*b* corresponding to a region including the movable portion KB is removed to provide a space KK. Consequently, the movable portion KB constitutes a cantilever having its fulcrum in a portion where the slits 21 are not provided. This structure allows an end edge portion opposite to the fulcrum to move upward and downward in FIG. 2A. The lower contact electrode 12 and the lower driving electrode 14 are brought into close contact with and formed on a surface of the movable portion KB.

As illustrated in FIG. 2A, the upper driving electrode 15 is formed of electrode bases 15*a* and 15*c* that are formed in close contact with the active layer 11*c*, and an electrode opposing portion 15*b* that is supported by the electrode bases 15*a* and 15*c* and forms a bridge straddling over the movable portion KB. The electrode opposing portion 15*b* faces the rectangular portion of the lower driving electrode 14 thereabove.

The active layer 11*c* of the substrate 11 is provided with slits 22 and 23 having a substantially rectangular shape so as to encompass the electrode bases 15*a* and 15*c* of the upper driving electrode 15, respectively.

Referring to FIGS. 1-2C, the slits 22 and 23 are loop-like grooves formed to penetrate through the active layer 11*c*. Each of the slits 22 and 23 has a width of approximately a few micrometers, for example, approximately 2 μm. Stated differently, in this embodiment, the active layer 11*c* is not provided in the parts corresponding to the slits 22 and 23, and the intermediate oxide film 11*b* is exposed at the parts. The slits 22 and 23 insulate the electrode bases 15*a* and 15*c* from the lower contact electrode 12, the upper contact electrode 13, the lower driving electrode 14, and so on because of the high insulation resistance.

The slit 22 has an area common to the large slit 21*a*. The slit 23 has an area common to the small slit 21*b*. In other words, the small slit 21*b* is formed as a part of the slit 23. Instead, however, the slits 22 and 23 may be formed independently of the slit 21.

The upper contact electrode 13 has a contact portion ST that is provided to face the lower contact electrode 12 thereabove. A contact that can be opened and closed is formed between the lower contact electrode 12 and the contact portion ST of the upper contact electrode 13, and is closed when the movable portion KB deforms upward to thereby bring the lower contact electrode 12 into contact with the contact portion ST. The lower contact electrode 12 and the upper contact electrode 13A constitute a high-frequency signal line SL, and a high-frequency signal passes through the high-frequency signal line SL when the contact closes. The upper driving electrode 15 is provided in parallel with the high-frequency signal line SL.

The ground electrode 16 constituted by side portions 16*a*-16*d* is formed, on the substrate 11, in a rectangular frame shape to encompass the entire device including the lower contact electrode 12, the upper contact electrode 13, the lower driving electrode 14, and the upper driving electrode 15. The side portion 16*a* that is one side of the ground electrode 16 is provided in parallel with the high-frequency signal line SL.

A metallic material such as gold (AU) is used as a material of the lower contact electrode 12, the upper contact electrode 13, the lower driving electrode 14, the upper driving electrode 15, and the ground electrode 16. The lower contact electrode 12 and the lower driving electrode 14 are formed to have a thickness of approximately 0.5 μm by spattering. The upper contact electrode 13, the upper driving electrode 15, and the ground electrode 16 are formed to have a thickness (height) of approximately 20 μm by plating.

Referring to FIG. 1, each of the lower contact electrode 12 and the lower driving electrode 14 is provided, in its entirety, as a thin layer formed by spattering. However, it is possible to form an anchor portion for electrode connection in the lower contact electrode 12 and the lower driving electrode 14, if necessary.

As illustrated in FIG. 3, a bump 19, more specifically, a bump 19*a*, 19*b*, 19*c*, 19*d*, or 19*e*, is formed on each of the electrodes or the anchor portion thereof if necessary. The bump 19 is made of a metallic material such as gold to have a maximum diameter of, for example, approximately 60 μm and a length of, for example, approximately 100 μm. The bump 19 is fixed to the upper surface of each of the electrodes or the anchor portion thereof by ultrasonic welding or fusion bonding.

The lower driving electrode 14 and the ground electrode 16 are connected to the ground potential, i.e., connected to the ground as depicted in FIG. 3. A positive driving voltage VD or a negative driving voltage VD is applied to the upper driving electrode 15 facing the lower driving electrode 14.

With respect to a direct current or a relatively low frequency signal, the upper driving electrode 15 maintains a sufficiently high impedance between the upper driving electrode 15 and the ground potential. Accordingly, even when a driving voltage VD is applied to the upper driving electrode 15, power consumption due to the impedance is either zero or greatly low. On the other hand, with respect to a high-frequency signal, the upper driving electrode 15 has a sufficiently low impedance because of the stray capacitance between the upper driving electrode 15 and the ground electrode 16, for example.

The high-frequency signal line SL forms a coplanar line structure (CPW) along with the side portion 16*a* that is one side of the ground electrode 16, and the upper driving electrode 15, so that the transmission loss is suppressed at a low level. In this way, the presence of the ground electrode 16 contributes to impedance matching in the high-frequency signal line SL. It is, therefore, possible to miniaturize the MEMS switch 1.

Another structure is possible in which a capacitor is provided, for example, between the upper driving electrode 15 and the ground electrode 16; thereby to lower the impedance with respect to a high-frequency signal between the upper driving electrode 15 and the ground electrode 16.

Descriptions are given below of a MEMS switch 1*h* that is a variation of the MEMS switch 1 according to the first embodiment.

Figure 4:
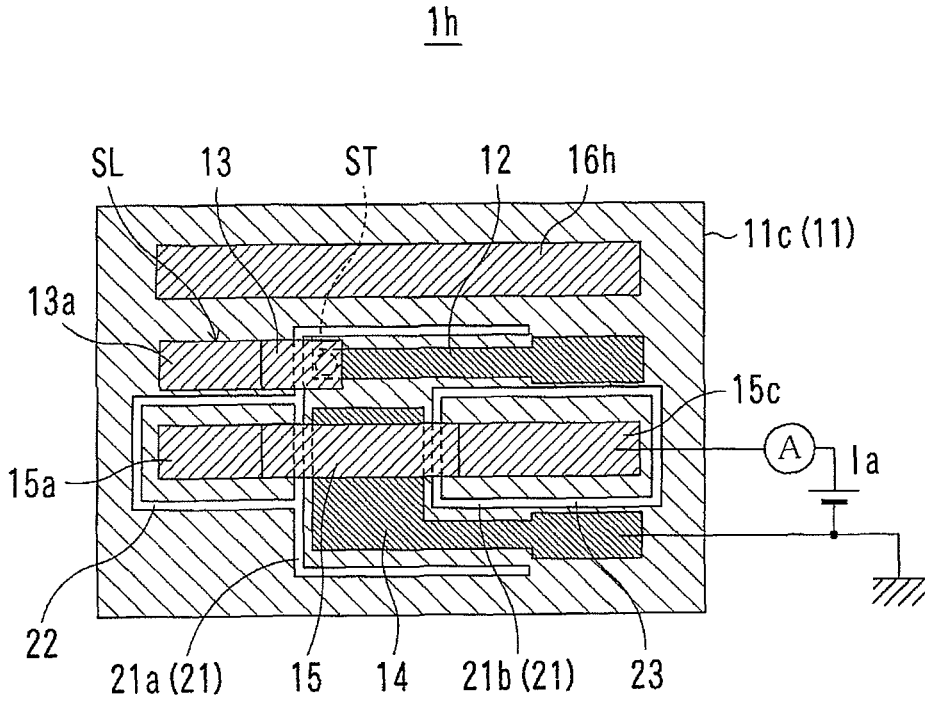
FIG. 4 is a plan view of a variation of the MEMS switch according to the first embodiment.

Referring to FIG. 4, the MEMS switch 1*h* is realized by removing the three side portions 16*b*-16*d* of the ground electrode 16 from the MEMS switch 1 illustrated in FIG. 3. Stated differently, the linear side portion 16*a* of the MEMS switch 1 functions as a ground electrode 16*h* of the MEMS switch 1*h* instead of the ground electrode 16 having a rectangular frame shape illustrated in FIG. 1. The structures of portions other than the ground electrode 16*h* are the same as those of the MEMS switch 1 according to the first embodiment.

The following is a brief description of a method for manufacturing the MEMS switch 1.

First, for example, a substrate of an SOI wafer is prepared as the substrate 11. As described earlier with reference to FIG. 2, the substrate 11 includes the support substrate 11*a*, the intermediate oxide film 11*b*, and the active layer 11*c*. A film of chrome is formed to have a thickness of approximately 50 nm as a close-contact layer, and subsequently, a film of gold is formed to have a thickness of approximately 500 nm on a surface of the active layer 11*c* by sputtering. Then, the resultant is processed by photolithography and ion milling to simultaneously form the lower contact electrode 12 and the lower driving electrode 14.

Next, the two slits 21*a* and 21*b* having large and small horizontal U-shapes and having widths of approximately 2 μm, respectively, are processed in the active layer 11*c* by Deep-RIE (Reactive Ion Etching) to thereby form a portion corresponding to the cantilever.

At the same time, the two slits 22 and 23 having a width of approximately 2 μm are worked in the active layer 11*c* by the Deep-RIE and formed to encompass the electrode bases 15*a* and 15*c*, respectively. Thereafter, a sacrifice layer is formed by forming a film of silicon dioxide ($SiO_2$) having a thickness of approximately 5 μm by plasma CVD (Chemical Vacuum Deposition) method.

Subsequently, the sacrifice layer is etched by photolithography and RIE. During this process, the sacrifice layer is half-etched to a desired depth for the contact portion ST and an actuator portion, while the sacrifice layer is completely removed for the portions corresponding to the anchor portions, the electrode bases 13*a*, 15*a*, and 15*c*, and the like.

Then, a seed layer required for plating is formed by sputtering. The seed layer is formed of an under layer of molybdenum having a thickness of approximately 50 nm and an upper layer of gold having a thickness of approximately 300 nm. Next, a gold plating film having a thickness of approximately 20 μm is formed by plating method. At this time, the ground electrode 16 is formed to encompass all of the cantilever, the high-frequency signal line SL, and so on.

Note that, in the case of the MEMS switch 1*h*, the ground electrode 16*h* is formed instead of the ground electrode 16 of the MEMS switch 1.

Next, parts of the seed layer that are not covered by plating are removed by ion milling and RIE. Then, the sacrifice layer and the intermediate oxide film 11*b* under the cantilever are removed by etching using hydrofluoric acid to thereby form the space KK. In addition, molybdenum of the under layer of the seed layer which is exposed on the surface of the contact portion ST protruding from the upper contact electrode 13 is removed by wet etching. Further, the bump 19 is provided by, for example, welding, if necessary.

Note that the lower contact electrode 12 and the lower driving electrode 14 are taken as examples of a movable electrode, and the upper contact electrode 13 and the upper driving electrode 15 are taken as examples of a fixed electrode.

Descriptions are given below of a leakage current Ia in the MEMS switch 1 and the MEMS switch 1*h* manufactured as discussed above.

With the MEMS switch 1 illustrated in FIG. 1, when the driving voltage VD is set at 40 V, the leakage current Ia is approximately 0.1 μA or smaller. Therefore, power consumption due to the leakage current Ia is approximately 4 μW or smaller, which is a greatly low level. The level of the power consumption is a level that can be ignored in, for example, a portable terminal.

Likewise, with the MEMS switch 1*h* illustrated in FIG. 4, when the driving voltage VD is set at 40 V, the leakage current Ia is approximately 0.1 μA or smaller. Power consumption due to the leakage current Ia is approximately 4 μW or smaller, which is a greatly low level.

Figure 11:
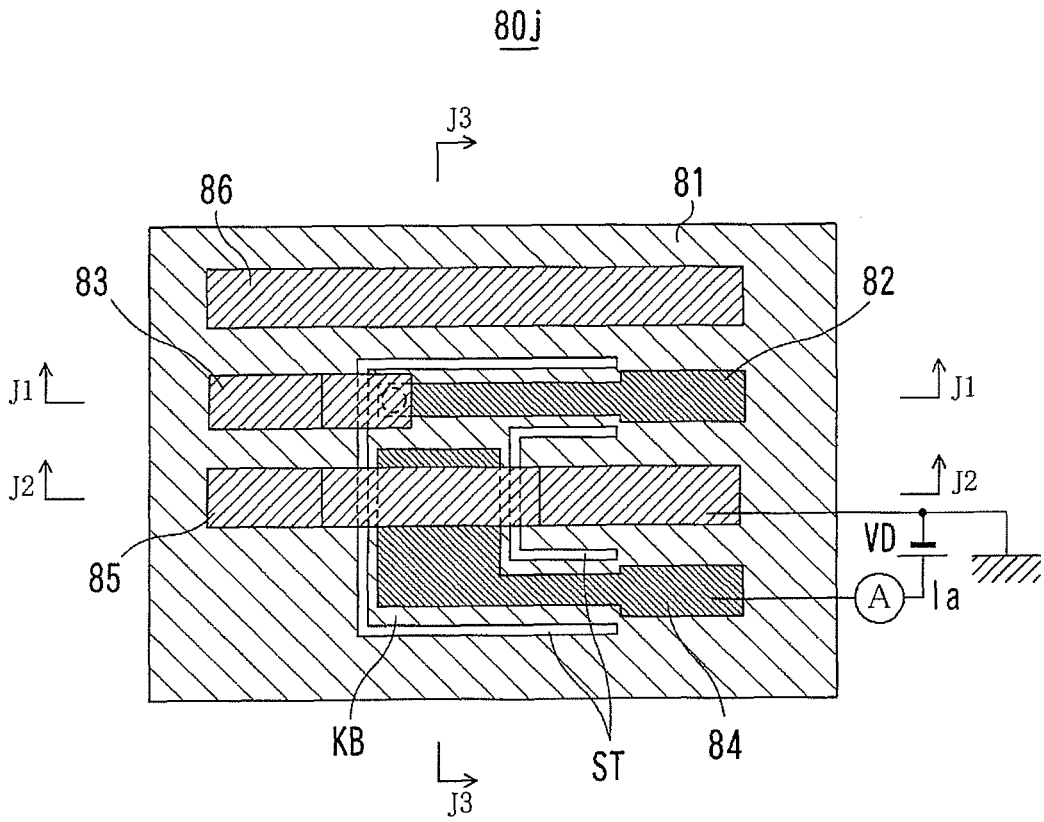
FIG. 11 RELATED ART
FIG. 11 is a plan view of a conventional MEMS switch.
Figure 12A:
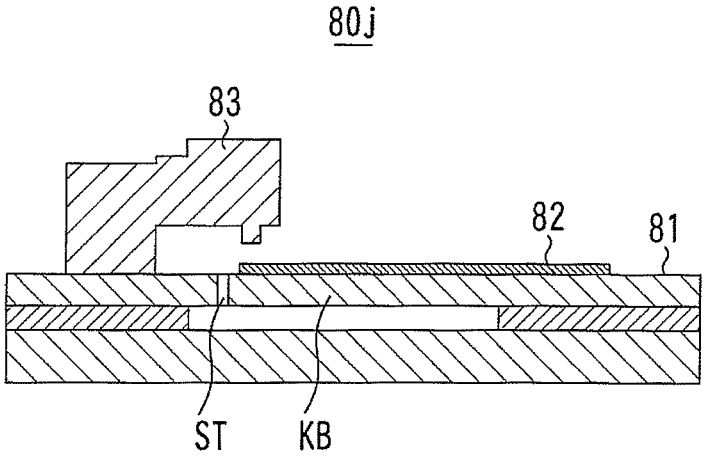
FIG. 12A RELATED ART
FIGS. 12A-12C are cross sectional views of a conventional MEMS switch.
Figure 12B:
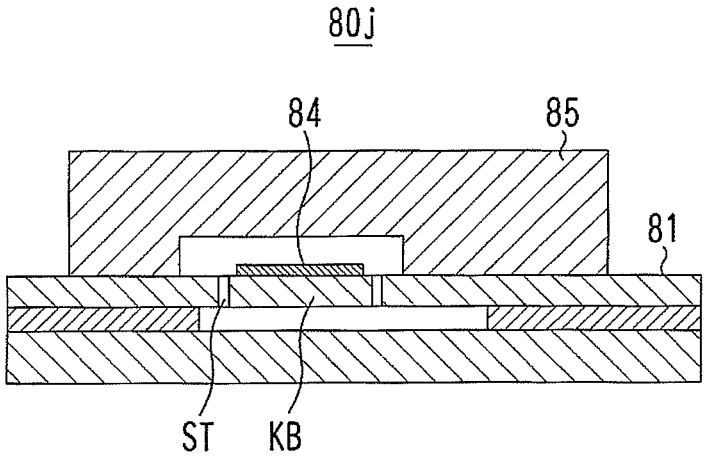
FIG. 12B RELATED ART
Figure 12C:
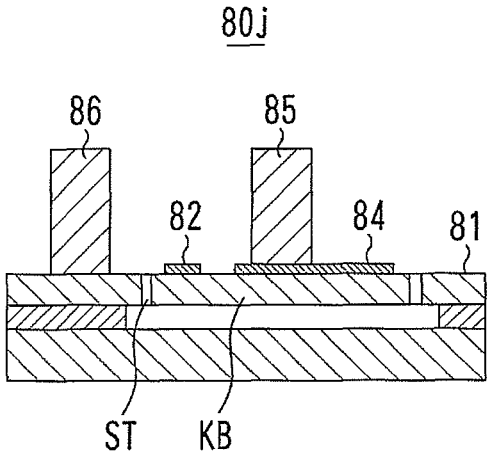
FIG. 12C RELATED ART

In essence, with the MEMS switch 1 and the MEMS switch 1*h*, the leakage current Ia and the power consumption due to the leakage current Ia are greatly reduced as compared with the MEMS switch having a conventional structure, illustrated in FIG. 11, in which the leakage current Ia is approximately 10 μA and the power consumption due to the leakage current Ia is approximately 400 μW.

Further, in the MEMS switch having a conventional structure, the leakage current Ia is carried to a contact portion, which is sometimes a cause of contact sticking. To be specific, even when the driving voltage VD is set at zero, a lower contact electrode sometimes remains stuck to the contact portion and is not separated therefrom.

By contrast, the leakage current Ia is greatly reduced in the MEMS switches 1 and 1*h* of the first embodiment, so that the leakage current Ia is not carried to the contact portion ST. Therefore, there is little possibility that contact sticking occurs.

The following is a description of properties of the MEMS switch 1 and the MEMS switch lh formed as discussed above.

Figure 5:
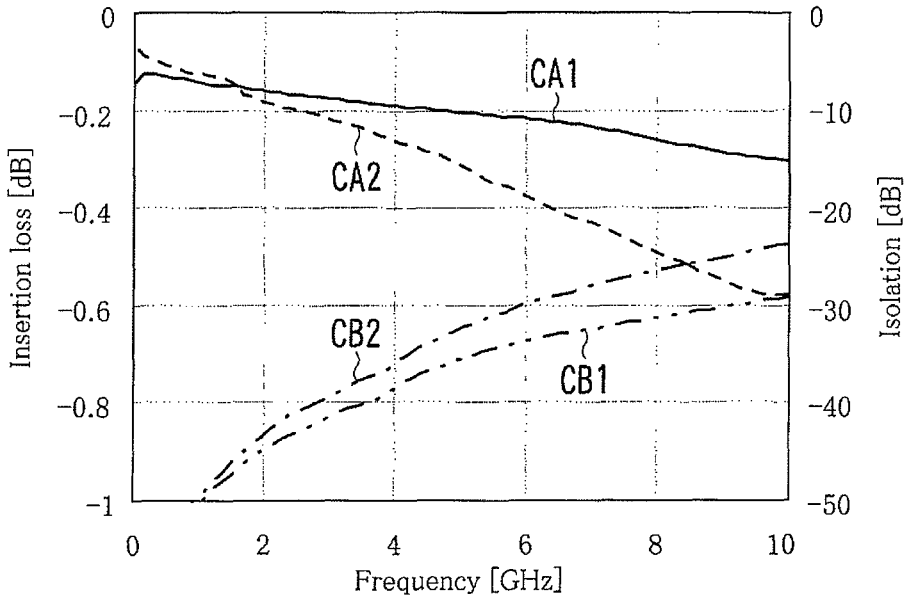
FIG. 5 is a graph illustrating frequency properties of MEMS switches.
Figure 6:
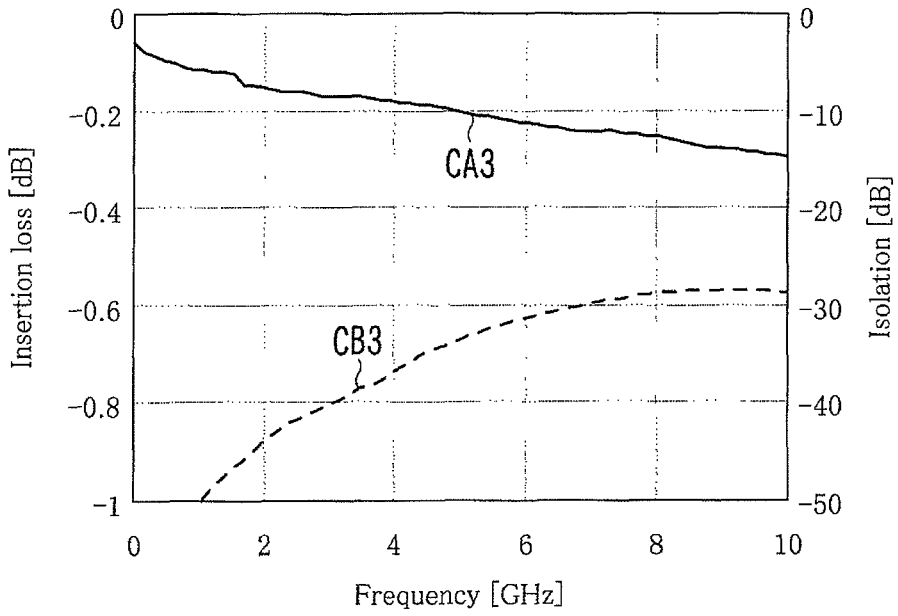
FIG. 6 is a graph illustrating frequency properties of a MEMS switch.

Referring to FIGS. 5 and 6, the graphs indicate frequency (GHz) on the horizontal axis, insertion loss on the left vertical axis (left scale), and isolation on the right vertical axis (right scale). The isolation indicates insulation properties of the contact portion ST in a state where the contact portion ST is separated from the lower contact electrode 12.

In FIG. 5, curves CA1 and CB1 represent insertion loss and isolation, respectively, of the MEMS switch having a conventional structure illustrated in FIG. 11. Curves CA2 and CB2 represent insertion loss and isolation, respectively, of the MEMS switch 1*h* illustrated in FIG. 4 and taken as a variation of the MEMS switch 1.

The graph of FIG. 5 indicates that, with respect to the insertion loss and the isolation, the MEMS switch 1*h* of FIG. 4 has properties slightly lower than those of the MEMS switch having a conventional structure. For example, when the frequency is 10 GHz, the MEMS switch having a conventional structure has insertion loss of 0.3 dB, and the MEMS switch 1*h* of FIG. 4 has insertion loss of 0.56 dB. One of the reasons for this is probably that the ground electrode 16*h* of the MEMS switch 1*h* is not formed to have a frame shape, and therefore, a complete coplanar line structure is not achieved in the MEMS switch 1*h*.

However, as long as the MEMS switch 1*h* has such properties as described above, in many cases, no problem arises in the case of the practical use thereof. It is thus possible to use the MEMS switch 1*h* as a high-frequency MEMS switch in which the leakage current Ia is greatly reduced.

The MEMS switch 1 illustrated in FIG. 1 is provided with the ground electrode 16 having a frame shape, and thereby, an almost complete coplanar line structure is probably provided. Therefore, both insertion loss and isolation are improved in the MEMS switch 1.

Referring to FIG. 6, curves CA3 and CB3 represent insertion loss and isolation, respectively, of the MEMS switch 1 illustrated in FIG. 1.

As seen from the graph of FIG. 6, when the frequency is 10 GHz, the MEMS switch 1 illustrated in FIG. 1 has insertion loss of 0.3 dB, which is equivalent to that of the MEMS switch having a conventional structure illustrated in FIG. 11. Further, the MEMS switch 1 of FIG. 1 has isolation equivalent to that of the MEMS switch having a conventional structure.

As discussed above, the MEMS switches 1 and 1*h* according to the first embodiment suppress the leakage current Ia and thereby to reduce the power consumption due to the leakage current Ia. Further, there is little possibility that contact sticking occurs due to the leakage current Ia, so that the stable operation is achieved in the MEMS switches 1 and 1*h*. Moreover, the reduction in the leakage current Ia leads to the reduced heat due to the leakage current Ia, so that the MEMS switches 1 and 1*h* can be further miniaturized.

[Second Embodiment]

Descriptions are given of a MEMS switch 1B of the second embodiment.

In the MEMS switch 1B of the second embodiment, portions that are the same as those of the MEMS switch 1 of the first embodiment are identified with the identical reference symbols, and the description thereof will be omitted or simplified. This also applies to a third embodiment and beyond described later.

Figure 7:
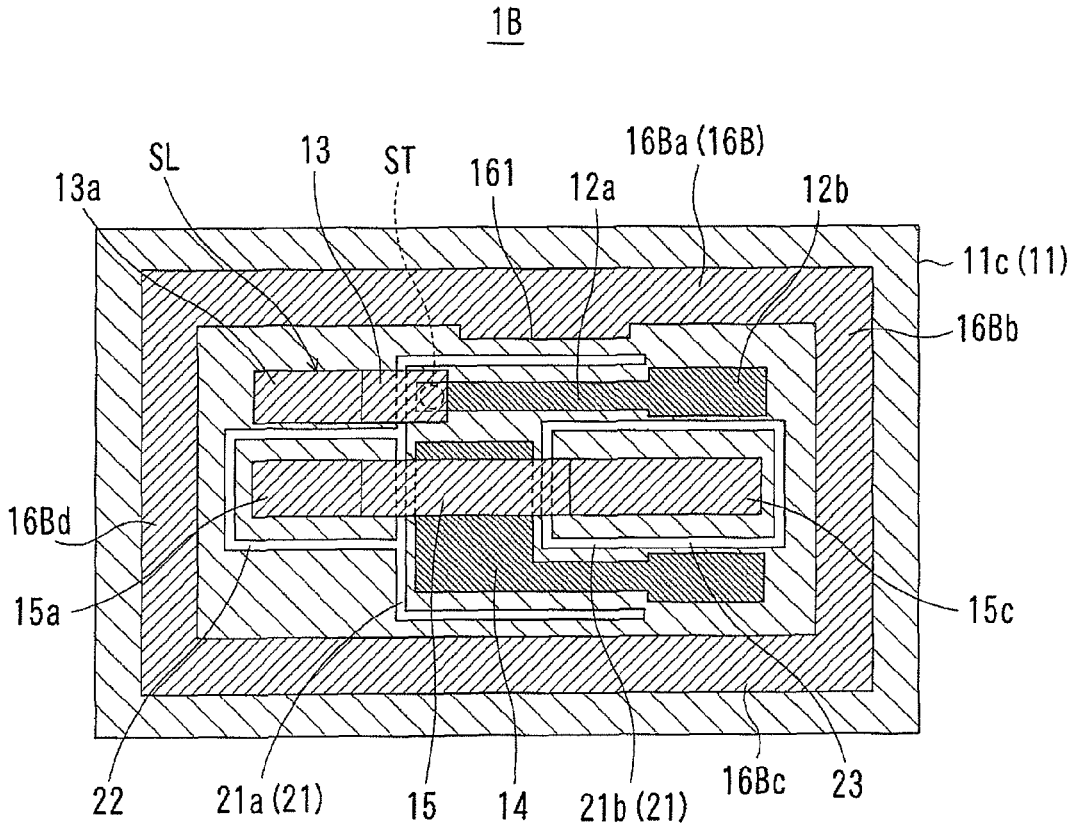
FIG. 7 is a plan view of a MEMS switch according to a second embodiment.

In the MEMS switch 1B illustrated in FIG. 7, a ground electrode 16B is formed in such a manner that a side portion 16Ba thereof near the high-frequency signal line SL projects inward so as to be close to the lower contact electrode 12.

The lower contact electrode 12 is formed of an elongated electrode portion 12*a* having a small thickness and formed in close contact with the movable portion KB, and an anchor portion 12*b* formed on one end of the electrode portion 12*a*.

The electrode portion 12*a* has a width smaller than that of the anchor portion 12*b*. If the side portion 16Ba of the ground electrode 16 is formed to have a linear shape, the distance between the side portion 16Ba and the electrode portion 12*a* is not equal to the distance between the side portion 16Ba and the anchor portion 12*b*, which probably leads to the impedance mismatch. In order to improve the impedance mismatch, an extending portion 161 is provided on the inner side of the side portion 16Ba, so that the distance between the upper contact electrode 13 and the ground electrode 16 is equal to the distance between the lower contact electrode 12 and the ground electrode 16.

More specifically, the distance between an edge of the extending portion 161 and an edge of the electrode portion 12*a*, the distance between an edge of the anchor portion 12*b* and an edge of the side portion 16Ba other than the extending portion 161, and the distance between an edge of the upper contact electrode 13 and the edge of the side portion 16Ba other than the extending portion 161 are substantially the same as one another.

Stated differently, the ground electrode 16B is formed in such a manner that, as for a portion of the ground electrode 16B along the lower contact electrode 12 and a portion of the ground electrode 16B along the upper contact electrode 13, a gap between the former portion and the lower contact electrode 12 is substantially the same as a gap between the latter portion and the upper contact electrode 13, and, that the former and latter portions have shapes corresponding to the shapes of the lower contact electrode 12 and the upper contact electrode 13, respectively.

Thus, the MEMS switch 1B contributes to further improvement in impedance matching in the high-frequency signal line SL, and to further reduction in the insertion loss.

[Third Embodiment]

Descriptions are given of a MEMS switch 1C of the third embodiment.

Figure 8:
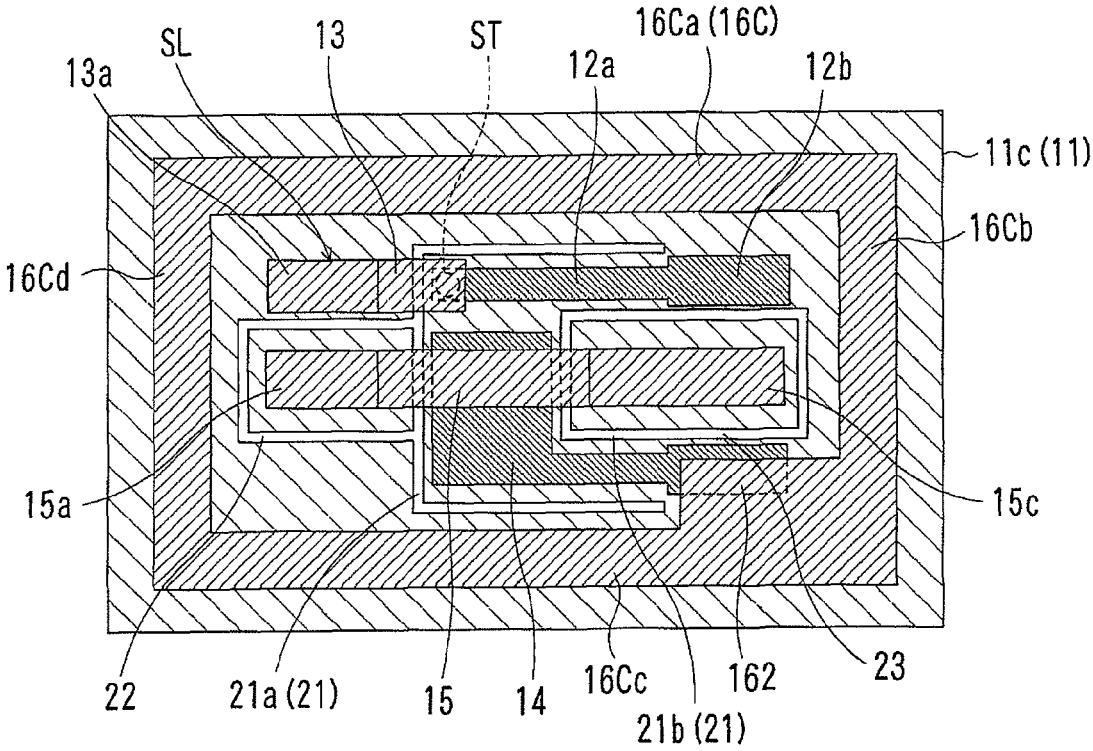
FIG. 8 is a plan view of a MEMS switch according to a third embodiment.

In the MEMS switch 1C illustrated in FIG. 8, a ground electrode 16C is formed to partially cover a lower driving electrode 14, so that the ground electrode 16C and the lower driving electrode 14 are electrically connected to each other.

To be specific, the ground electrode 16C has an extending portion 162 projecting inward around a connection part at which a side portion 16Cb and a side portion 16Cc are connected to each other. The extending portion 162 is connected in overlapping relation with a part of the lower driving electrode 14.

This structure enables the lower driving electrode 14 to be securely connected to the ground. In addition, this structure does not need a bump 19*d* (see FIG. 3) exclusively used for the ground connection of the lower driving electrode 14, which leads to the reduced number of terminals and wires.

The extending portion 162 is preferably formed at the same time with the formation of the ground electrode 16C by plating, and therefore the number of steps is not increased.

[Fourth Embodiment]

Descriptions are given of a MEMS switch 1D of the fourth embodiment.

Figure 9:
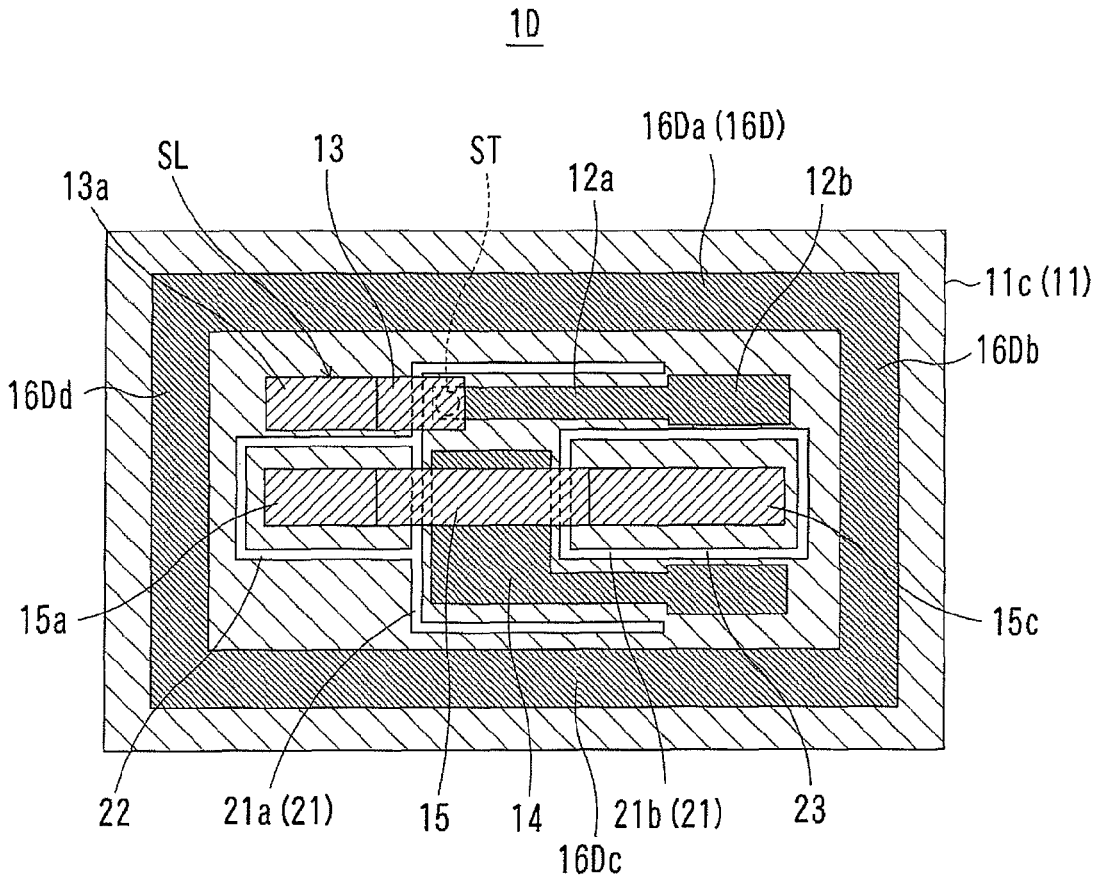
FIG. 9 is a plan view of a MEMS switch according to a fourth embodiment.

In the MEMS switch 1D illustrated in FIG. 9, a ground electrode 16D is formed as a thin layer by sputtering.

According to the MEMS switches 1, 1*h*, 13, and 1C of the first through third embodiments, the individual ground electrodes 16 are formed to have a thickness of approximately 20 μm by plating. On the other hand, in the MEMS switch 1D of the fourth embodiment, the ground electrode 16D is formed to have a thickness of approximately 0.5 μm by sputtering. The ground electrode 16D can be formed at the same time with the formation of the lower contact electrode 12 and the lower driving electrode 14.

Stated differently, the lower contact electrode 12, the lower driving electrode 14, and the ground electrode 16D have the same layer structure.

The thickness of the ground electrode 16D is reduced, resulting in the reduction in the amount of the material such as gold used for forming the ground electrode 16D. It is, therefore, possible to manufacture the MEMS switch 1D at low cost by an amount of the reduced material.

[Fifth Embodiment]

Descriptions are given of a MEMS switch 1E of the fifth embodiment.

Figure 10:
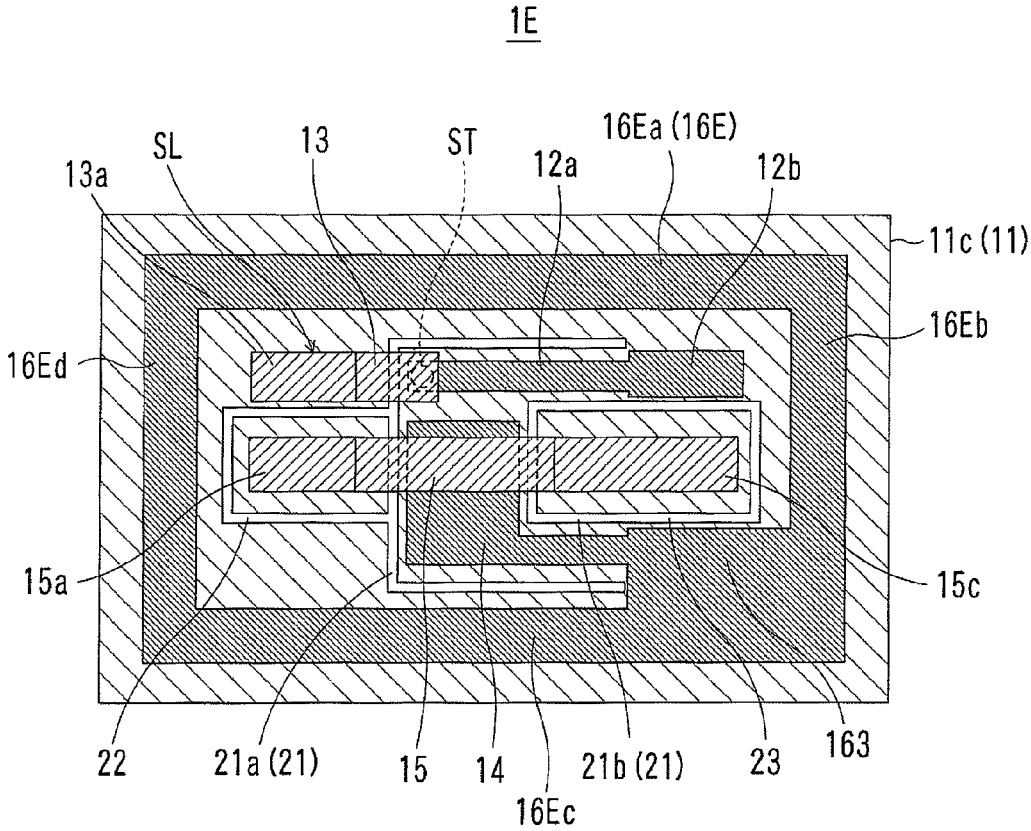
FIG. 10 is a plan view of a MEMS switch according to a fifth embodiment.

In the MEMS switch 1E illustrated in FIG. 10, a ground electrode 16E is formed as a thin layer by sputtering. The ground electrode 16E has an extending portion 163 projecting inward around a connection part at which a side portion 16Eb and a side portion 16Ec are connected to each other. The extending portion 163 is integrally and continuously formed with a part of the lower driving electrode 14. In short, the lower driving electrode 14 and the ground electrode 16E are connected to each other.

To be specific, as with the case of the MEMS switch 1D of the fourth embodiment, the ground electrode 16E of the MEMS switch 1E in the fifth embodiment is formed to have a thickness of approximately 0.5 μm by sputtering. The ground electrode 16E is formed at the same time with the formation of the lower contact electrode 12 and the lower driving electrode 14.

The thickness of the ground electrode 16E is reduced, resulting in the reduction in the amount of the material such as gold used for forming the ground electrode 16E. It is, therefore, possible to manufacture the MEMS switch 1E at low cost by an amount of the reduced material. In addition, this structure enables the lower driving electrode 14 to be securely connected to the ground. This structure does not need a bump 19*d* (see FIG. 3) exclusively used for the ground connection of the lower driving electrode 14, which leads to the reduced number of terminals.

Since the lower contact electrode 12, the lower driving electrode 14, and the ground electrode 16E can be formed concurrently, it is possible to reduce the number of steps.

In the MEMS switches 1B-1E of the second through fifth embodiments, an anchor portion for electrode connection may be provided, if necessary, in the lower contact electrode 12 and the lower driving electrode 14.

As with the MEMS switch 1*h* which is a variation of the MEMS switch 1 of the first embodiment, the MEMS switches 1B-1E of the second through fifth embodiments may be configured to provide the linear side portion 16*a* as a ground electrode instead of the rectangular frame ground electrode 16.

The MEMS switches 1C-1E of the third through fifth embodiments may be configured to provide an extending portion similar to the extending portion 161 formed on the side portion 16Ba of the MEMS switch 1B of the second embodiment; thereby to further improve the impedance matching in the high-frequency signal line SL.

In the case where a bump 19*d* is provided in the lower contact electrode 12 of the MEMS switches 1, 1*h*, 1B, and 1D of the first, second, and fourth embodiments, the bump 19*d* functions as a ground electrode for connecting the lower contact electrode 12 to the ground. Alternatively, it is possible to provide a ground electrode for connecting the lower contact electrode 12 to the ground separately from the bump 19*d* or the like.

All of the MEMS switches 1, 1*h*, and 1B-1E of the first through fifth embodiments discussed above are configured to suppress the leakage current Ia and reduce the power consumption due to the leakage current Ia.

In the MEMS switches 1, 1*h*, and 1B-1E according to the embodiments described above, the configuration, structure, form, dimensions, thickness, quantity, layouts, material, formation method, formation sequence, and the like of the entirety or individual portions thereof may be altered as required in accordance with the subject matter of the present invention.

The embodiments discussed above are applicable to various types of electronic devices other than the MEMS switch, although the high-frequency MEMS switch is described in the embodiments.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An electronic device comprising:

a substrate including an active layer;

a signal electrode formed on a surface of the active layer;

a first driving electrode that is formed as a movable electrode on the surface of the active layer and is connected to a ground; and a second driving electrode that is formed as a fixed electrode and includes a first part that is formed on the surface of the active layer and a second part that is connected to the first part and is provided above the first driving electrode, wherein the substrate is provided with a loop-like groove that penetrates through the active layer and encompasses the first part.

2. The electronic device according to claim 1, further comprising a ground electrode that is formed on the substrate to encompass the signal electrode, the first driving electrode, and the second driving electrode, and is connected to the ground.

3. The electronic device according to claim 2, wherein the first driving electrode and the ground electrode are electrically connected to each other on the substrate.

* * * * *